US006109993A

United States Patent [19]

Aono et al.

[11] Patent Number: 6,109,993

[45] Date of Patent: Aug. 29, 2000

[54] FLAT TYPE IMAGE DISPLAY APPARATUS AND FABRICATION METHOD THEREFOR

[75] Inventors: Hiroshi Aono; Mitsunori Yokomakura, both of Takatsuki; Mitsunori Katano, Sanda; Michiaki Watanabe, Ibaraki, all of Japan

[73] Assignee: Matsushita Electric Industrial Co., Ltd., Kadoma, Japan

[21] Appl. No.: 08/530,642

[22] Filed: Sep. 20, 1995

Related U.S. Application Data

[62] Division of application No. 08/312,865, Sep. 27, 1994, Pat. No. 5,554,910.

[30] Foreign Application Priority Data

Sep. 30, 1993 [JP] Japan ..... 5-244565

[51] Int. Cl.[7] ..... H01J 9/30

[52] U.S. Cl. ..... 445/24; 445/29

[58] Field of Search ..... 445/24, 29, 33

[56] References Cited

U.S. PATENT DOCUMENTS

| | | | |
|---|---|---|---|
| 3,666,911 | 5/1972 | Armstrong | 445/24 |
| 4,451,759 | 5/1984 | Heynisch | 445/24 |
| 4,493,666 | 1/1985 | Nonomura et al. . | |
| 4,517,489 | 5/1985 | Glock et al. | 445/24 |
| 4,955,681 | 9/1990 | Sekihara et al. . | |
| 5,172,028 | 12/1992 | Watanabe . | |
| 5,175,467 | 12/1992 | Yamazaki et al. . | |
| 5,232,389 | 8/1993 | Yamazaki et al. . | |
| 5,256,937 | 10/1993 | Bubeck et al. . | |
| 5,272,413 | 12/1993 | Yamazaki et al. . | |

FOREIGN PATENT DOCUMENTS

| | | | |
|---|---|---|---|
| 0050295 | 4/1982 | European Pat. Off. . | |
| 050295 | 4/1982 | European Pat. Off. . | |
| 316871 | 5/1989 | European Pat. Off. . | |
| 3-67444 | 3/1991 | Japan . | |
| 5-12992 | 1/1993 | Japan | 445/24 |
| 81/00029 | 1/1981 | WIPO . | |

OTHER PUBLICATIONS

Patent Abstracts of Japan, Kokai 60–68819, published Mar. 11, 1994, vol. 18, No. 308(E–1560), Abstract date Jun. 13, 1994.

*Primary Examiner*—P. Austin Bradley
*Assistant Examiner*—Jeffrey T. Knapp
*Attorney, Agent, or Firm*—Cushman Darby & Cushman IP Group of Pillsbury Madison & Sutro LLP

[57] ABSTRACT

A substantially rectangle shaped frame for holding a flat-shaped electrode unit 7 is fixed to a rear panel 2 at four intermediate parts of the frame and is elastically held by a resilient retaining member 55*a*- - - 55*d* and 56*a*- - - –56*d* at four corners of the frame. Thereby, an engagement between the rear panel 2 and the flat-shaped electrode unit 7 via the frame is stably retained regardless of difference in degrees of deformations thereamong.

2 Claims, 11 Drawing Sheets

FLAT TYPE IMAGE DISPLAY APPARATUS AND FABRICATION METHOD THEREFOR

This is a division of application Ser. No. 08/312,865, filed Sep. 27, 1994, now U.S. Pat. No. 5,554,910.

FIELD OF THE INVENTION AND RELATED ART STATEMENT

1. Field of the Invention

The present invention relates to a flat type image display apparatus which is to be used in a television receiver and a display unit for computers or the like.

2. Description of the Prior Art

In recent years, a color image display apparatus has been developed for achieving a compact size vigorously.

In an electron beam scanning type of the color image display apparatus, a flat type image display apparatus is disclosed in the unexamined published Japanese application (TOKKAI) HEI 3-67444. Such flat type image display apparatus is generally characterized as follows:

(1) A distance between a cathode and an anode is remarkably shorter than that of a conventional cathode-ray tube type.

(2) A fluorescent screen is divided horizontally and vertically into the matrix arrangement of plural small segments, and each of the small segments is scanned by deflecting one electron beam which is separated from the other electron beams.

(3) Fluorescent dots of R (red), G (green) and B (blue) for one picture element in the small segment are shot in turn by the electron beam of which an amount of the irradiation is controlled by color picture signals.

(4) Television moving pictures as a whole are reproduced on the fluorescent screen by arranging all small segments.

The flat type image display apparatus generally comprises a flat box-shaped vacuum case including plural linear hot cathodes and a flat-shaped electrode unit. Each linear hot cathode (hereinafter referred to as linear cathodes) serves as a generator of the electron beam. The flat-shaped electrode unit has plural holes and plural slits for deflecting, focussing and controlling the electron beam. The electron beam emitted from each linear cathode passes through the holes and the slits. Thereby, the electron beam reaches the fluorescent screen via the above-mentioned steps of deflecting, focussing and controlling. As a result, the fluorescent screen emits light, and a television moving picture is reproduced on the fluorescent screen.

A concrete construction of the general flat type image display apparatus will be elucidated with reference to FIG. 8, FIG. 9 and FIG. 10. In the description of the prior art, a horizontal direction is shown by an arrow "X" of FIG. 8, and a vertical direction is shown by an arrow "Y" of FIG. 8. FIG. 8 is a perspective view showing the flat type image display apparatus. FIG. 9 is a cutaway perspective view, which is taken on line IX—IX of FIG. 8, showing a part of the flat type image display apparatus. FIG. 10 is an exploded perspective view showing general construction of a main part of the flat type image display apparatus.

As shown in FIG. 8, the flat type image display apparatus 100 has a vacuum case constituted by a front housing 1 and a rear panel 2. The front housing 1 and the rear panel 2 are made of glass which has a predetermined thickness, for example, 10 mm. Peripheral parts of the front housing 1 is fixed to the rear panel 2 by a bonding glass member 3, such as a soldering glass. The melting point of the bonding glass member 3 is selected lower than that of the front housing 1 or the rear panel 2, and the bonding glass member 3 seals the vacuum case via a melting and recrystallization. An evacuation pipe 4 for evacuating the vacuum case and a high voltage terminal 5 of the anode are provided on the edge of the front housing 1. Plural output terminals 6 are led out of the vacuum case through the bonding glass member 3.

As shown in FIG. 9, one ends of the plural output terminals 6 are connected with a flat-shaped electrode unit 7. In order to use the flat type image display apparatus 100 as a television receiver or a display unit of a computers the other ends of the plural output terminals 6 are to be connected with external circuits (not shown), for examples a driving circuit and signal processing circuit.

The flat-shaped electrode unit 7 is constituted by plural flat-shaped electrodes 7*a*- - - 7*g* (FIG. 10). At four corners of the flat-shaped electrode unit 7, four securing screws 8*a*- - - 8*d* (FIG. 11) set the flat-shaped electrode unit 7 on a conventional supporting unit 14 (FIG. 11), respectively. The flat-shaped electrodes 7*a*- - - 7*g* (FIG. 10) are made of an alloy, such as Ni and Fe (Ni:Fe=36%:64%).

As shown in FIG. 10, the main part of the flat type image display apparatus 100 comprises a back electrode 9, plural linear cathodes 10*a*- - - 10*c* and the flat-shaped electrode unit 7. The back electrode 9, plural linear cathodes 10*a*- - - 10*c* and the flat-shaped electrode unit 7 are provided from the rear panel 2 toward the front housing 1. The back electrode 9 is mounted on the inner surface of the rear panel 2. The linear cathodes 10*a*- - - 10*c* are horizontally stretched so as to be in parallel with the back electrode 9. The linear cathodes 10*a*- - - 10*c* act as an electron beam source. Although only three pieces of the linear cathodes 10*a*- - - 10*c* are shown in FIG. 10, there are actually many linear cathodes (e.g. 44 pieces).

The flat-shaped electrode unit 7 comprises an electron beam extracting electrode 7*a*, a modulation electrode 7*b*, a vertical focussing electrode 7*c*, a horizontal focussing electrode 7*d*, a horizontal deflection electrode 7*e*, a shield electrode 7*f* and a vertical deflection electrode 7*g*. The respective electrodes 7*a*- - - 7*g* are bonded with each other keeping respective predetermined gaps held therebetween, and they are electrically insulated from each other by respective vitreous insulators (not shown).

As shown in FIG. 10, the electrons emitted from the linear cathode 10*b* is conducted by an extracting hole 11 of the electron beam extracting electrode 7*a* to form the electron beam 12. Thereafter, the electron beam 12 passes through holes and slits of the other electrodes 7*b*, 7*c*, 7*d*, 7*e*, 7*f* and 7*g*, thereby getting focussed and deflected. Finally, the electron beam 12 reaches a small segment 13*a* of a fluorescent screen 13 formed on the inner surface of the front housing 1. Many fluorescent dots of R, G and B colors are provided on the small segment 13*a* by printing and coating, and the small segment 13*a* emits lights when the electron beam 12 lands on the fluorescent dots of the small segment 13*a*. Similarly, other electron beams land on the fluorescent dots of other small segments, and every small segment emits lights. As a result, the television moving picture is reproduced on the fluorescent screen 13. In FIG. 10, although the fluorescent screen 13 is divided into only 3 pieces in a vertical line and only 7 pieces in a horizontal line, the fluorescent screen 13 is actually divided into many small segments, such as 44 pieces in the vertical line and 221 pieces in the horizontal lines the total of 9724 pieces.

The conventional supporting unit 14 for the flat-shaped electrode unit 7 will be elucidated with reference to FIG. 11 and FIG. 12. FIG. 11 is an explanatory view showing a conventional supporting unit for the flat-shaped electrode unit. FIG. 12 is a partially sectional view, which is taken on line Z—Z of FIG. 8, showing the mounting construction of the conventional supporting unit at a corner part of the flat type image display apparatus.

As shown in FIG. 11 the conventional supporting unit 14 for the flat-shaped electrode unit 7 comprises six setting mounts 15*a*- - - 15*f*, a pair of securing members 16*a* and 16*b* and a pair of supporting members 17*a* and 17*b*. The six setting mounts 15*a*- - - 15*f* are made of an alloy, such as Ni and Fe (Ni:Fe=50%:50%), and fixed on a predetermined position of the rear panel 2 by a bonding glass member 19 (FIG. 12) so as to surround the back electrode 9 (shown in two-dot chain line). The melting point of the bonding glass member 19 is selected lower than that of the rear panel 2.

The securing members 16*a* and 16*b* are also made of the alloy, such as Ni and Fe (Ni:Fe=50%:50%), and located in parallel with each other in the vertical direction. Two securing screws 18*a* and 18*b* are set at both end parts of the securing member 16*a* on the setting mounts 15*a* and 15*b*, respectively. Similarly, securing screws 18*d* and 18*e* are set at both end parts of the securing member 16*b* on the setting mounts 15*d* and 15*e*, respectively.

The supporting members 17*a* and 17*b* are also made of the alloy, such as Ni and Fe (Ni:Fe=50%:50%), and located in parallel with each other in the horizontal direction. A securing screw 18*c* sets the intermediate part of the supporting member 17*a* on the setting mount 15*c* so that both ends of the supporting member 17*a* are put on one end of the securing members 16*a* and 16*b*, respectively. Similarly, a securing screw 18*f* sets the intermediate part of the supporting member 17*b* on the setting mount 15*f* so that both ends of the supporting member 17*b* are put on the other end of the securing member 16*a* and 16*b*, respectively.

As a result, as shown in FIG. 11, the respective ends of the supporting members 17*a* and 17*b* are put on the respective ends of the securing members 16*a* and 16*b*. Thereby, the securing members 16*a* and 16*b* and the supporting members 17*a* and 17*b* form a rectangle shaped frame on the six setting mounts 15*a*- - - 15*f*.

An insulating film 20 (FIG. 12) is provided on the upper surface of the supporting members 17*a* and 17*b*, and the flat-shaped electrode unit 7 (FIG. 10) is disposed further thereon. At four corners of the supporting unit 14, the flat-shaped electrode unit 7, the supporting members 17*a* and 17*b* and the securing members 16*a* and 16*b* are fixed to each other by four securing screws 8*a*- - - 8*d*.

As shown in FIG. 11, a securing position of the securing screw 8*a* is located at the part outside with respect to the setting mount 15*a* in relation to the center part of the rear panel 2, and a securing position of the securing screw 8*b* is located at the part outside with respect to the setting mount 15*b* in relation to the center part of the rear panel 2. Similarly, a securing position of the securing screw 8*c* is located at the part outside with respect to the setting mount 15*d* in relation to the center part of the rear panel 2, and a securing position of the securing screw 8*d* is located at the part outside with respect to the setting mount 15*e* in relation to the center part of the rear panel 2.

As shown in FIG. 12, each of the flat-shaped electrodes 7*a*- - - 7*g* of the flat-shaped electrode unit 7 is disposed in a predetermined position between the back electrode 9 and the fluorescent screen 13 by the conventional supporting unit 14. Insulating washers 21 are provided between every two flat-shaped electrodes around the securing screws 8*a*. A metal-backed layer 22 is provided on the inner surface of the fluorescent screen 13.

In the flat type image display apparatus 100, in order to obtain a high definition images the electron beam is required to make an exact scanning on the fluorescent screen 13 without mislanding. Therefore, it is necessary that the supporting unit 14 holds the flat-shaped electrode unit 7 at the predetermined position with precision of a micron order.

However, the flat type image display apparatus 100 is repeatedly put on an atmosphere of a high temperature and heated until completion of its' assembly as follows:

(1) When the setting mounts 15*a*- - - 15*f* are fixed on the rear panel 2 by the bonding glass member 19, the bonding glass member 19 is heated and melted in a baking oven at the temperature of about 500° C.

(2) When the front housing 1 is fixed to the rear panel 2 by the bonding glass member 3, the bonding glass member 3 is heated and melted in the baking oven at the temperature of about 500° C.

(3) When an inside space of the flat type image display apparatus 100 is evacuated by using the evacuation pipe 4, the flat type image display apparatus 100 is put in the baking oven at the temperature of 300° C. to 350° C.

Furthermore, since the linear cathode 10 is heated at the temperature of 600° C. to 700° C. for generating the electron beam, the inside space is exposed to radiation from linear cathode 10 during the operation of the flat type image display apparatus 100.

As a result, thermal deformations caused by the above-mentioned heating are generated in the flat type image display apparatus 100. The rear panel 29 the flat-shaped electrode unit 7 and the frame of the conventional supporting unit 14 are made of different materials from each other. Namely, in the rear panel 29 the flat-shaped electrode unit 7 and the frame of the conventional supporting unit 14, degrees of the thermal deformations are different from each other because of differences of coefficient of thermal expansion and thermal capacity. When the flat type image display apparatus 100 is heated, degrees of the thermal deformations become larger in order of the frame of the conventional supporting unit 14, the rear panel 2 and the flat-shaped electrode unit 7.

Furthermore, in the conventional supporting unit 149 it is impossible to minimize undesirable influences of a difference in degrees of thermal deformations caused by the above-mentioned heating completely. Therefore, in the flat type image display apparatus 100, some cracks and warps are generated at strength-weak points or collecting points of thermal stress by a thermal expansion.

Thereby, it is afraid that the conventional supporting unit 14 can not hold the flat-shaped electrode unit 7 at the predetermined position precisely. As a result, it is impossible to make an exactly scanning of the electron beam on the fluorescent screen 13. Accordingly, there is a problem that the high definition image is not reproduced on the fluorescent screen 13.

A concrete example of thermal deformation caused by the aforementioned heating will be elucidated with reference to FIG. 11 and FIG. 12.

In FIG. 11, when the flat type image display apparatus 100 is heated, the rear panel 2 is expanded into the rear panel 2' shown by dashed lines. Similarly, the supporting members 17*a* and 17*b* are deformed into the supporting members 17*a*' and 17*b*' shown by dashed lines, respectively. Plural arrows A, B, C, D, - - - P designate respective directions of the thermal deformation of the rear panel 2. In order to understand the thermal deformation easily, the rear panel 2' and the supporting members 17*a*' and 17*b*' are shown in FIG. 11 exaggeratedly.

As has been elucidated in the above, the flat-shaped electrode unit 7, the supporting members 17*a* and 17*b* and the securing members 16*a* and 16*b* are fixed to each other by four securing screws 8*a*- - - 8*d* at four corners of the supporting unit 14. Therefore, in the securing members 16*a* and 16*b* and the supporting members 17*a* and 17*b*, those degrees of the thermal deformation are limited by degree of the flat-shaped electrode unit 7 via the four securing 8*a*- - - 8*d*. Furthermore, the intermediate parts of the supporting member 17*a* and 17*b* is fixed to the setting mounts 15*c* and 15*f*, respectively. Accordingly, the respective intermediate parts are deformed more than the respective end parts by the thermal deformation of the rear panel 2 as shown in FIG. 11.

Since degree of the thermal deformation of the rear panel 2 is the largest at it's four corners, cracks are most generated at the setting mounts 15*a*, 15*b*, 15*d* and 15*e*.

A concrete example of the generation of cracks will be elucidated with reference to FIG. 12.

In FIG. 12, when the flat type image display apparatus 100 is heated, the securing member 16*a* and the rear panel 2 are deformed in directions shown by arrows S and R, respectively. However, the degree of the thermal deformation of the securing member 16*a* is larger than that of the rear panel 2. Therefore, plural cracks 23 are generated in the bonding glass member 19 and the rear panel 2. Plural cracks 23 are not always generated at the predetermined position and the predetermined degree. Therefore, in the prior art, an effective countermeasure has not been taken against plural cracks 23.

Furthermore, in the conventional supporting unit 14, it is necessary that the above-mentioned thermal deformations are taken into consideration. Therefore, precision of respective sizes of the securing members 16*a* and 16*b* and the supporting members 17*a* and 17*b* becomes severe, and the assembly of the conventional supporting unit 14 needs much time. As a result, cost of the flat type image display apparatus 100 is inevitably high.

Furthermore, when the inside space of the flat type image display apparatus 100 is evacuated by using the evacuation pipe 4, the central part of the rear panel 2 is deformed toward the front housing 1. However, in the conventional supporting unit 14, there is no consideration for this deformation. Therefore, it is afraid that the conventional supporting unit 14 can not hold the flat-shaped electrode unit 7 at the predetermined position precisely after the inside space of the flat type image display apparatus 100 is evacuated.

OBJECT AND SUMMARY OF THE INVENTION

The object of the present invention is to provide a flat type image display apparatus that can solve the aforementioned problems.

In order to achieve the above-mentioned object, a flat type image display apparatus in accordance with the present invention comprises:

- a vacuum case having a front housing and a rear panel;
- a fluorescent screen formed on an inner surface of the front housing;
- a back electrode formed on an inner surface of the rear panel;
- plural linear cathodes for emitting electron beams;
- a flat-shaped electrode unit for deflecting, focussing and controlling the electron beams; and
- a supporting unit for holding the flat-shaped electrode unit and having a substantially rectangle shaped frame and resilient retaining means, the substantially rectangle shaped frame holding the flat-shaped electrode unit, four intermediate parts of the substantially rectangle shaped frame being fixed to the rear panel, four corners of the substantially rectangle shaped frame being held elastically with each other by the resilient retaining means, whereby by means of the resilient retaining means an engagement between the rear panel and the flat-shaped electrode unit via the supporting unit is stably retained regardless of difference in degrees of deformations thereamong.

In the flat type image display apparatus of the present invention, the substantially rectangle shaped frame, which holds the flat-shaped electrode unit, is fixed to the rear panel at four intermediate parts of the frame; and the frame is elastically held by the resilient retaining means at four corners of the frame. Furthermore, the resilient retaining means eliminates adverse influence of, or absorbs, a difference in degrees of deformations among the rear panel, the flat-shaped electrode unit and the frame. In general at the four corners of the frame the differences the positional difference due to thermal deformations among the rear panel, the flat-shaped electrode unit and the frame are most. Furthermore, the resilient retaining means absorbs most the difference without giving an undesirable stress to the flat-shaped electrode unit. As a result, it is possible to make an exactly scanning of the electron beam on the fluorescent screen. Accordingly, the high definition image can be reproduced on the fluorescent screen.

DESCRIPTION OF THE PREFERRED EMBODIMENT

Hereafter, a preferred embodiment of the present invention is described with reference to the accompanying drawings.

Figure 8:
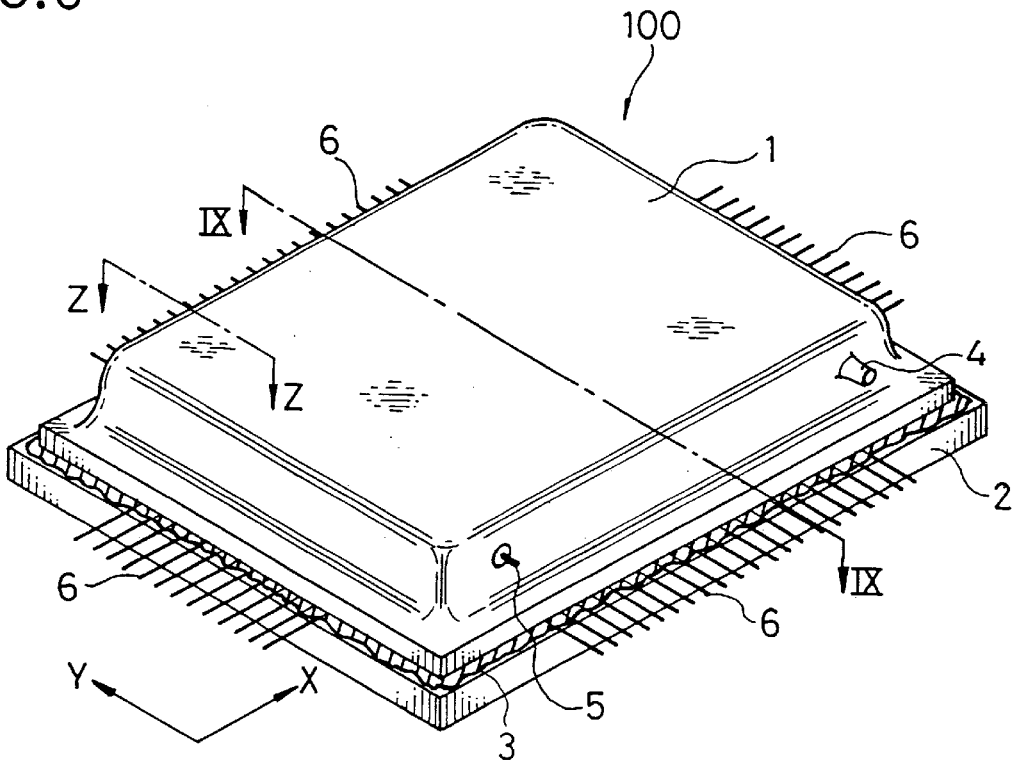
FIG. 8 is a perspective view showing the flat type image display apparatus.
Figure 9:
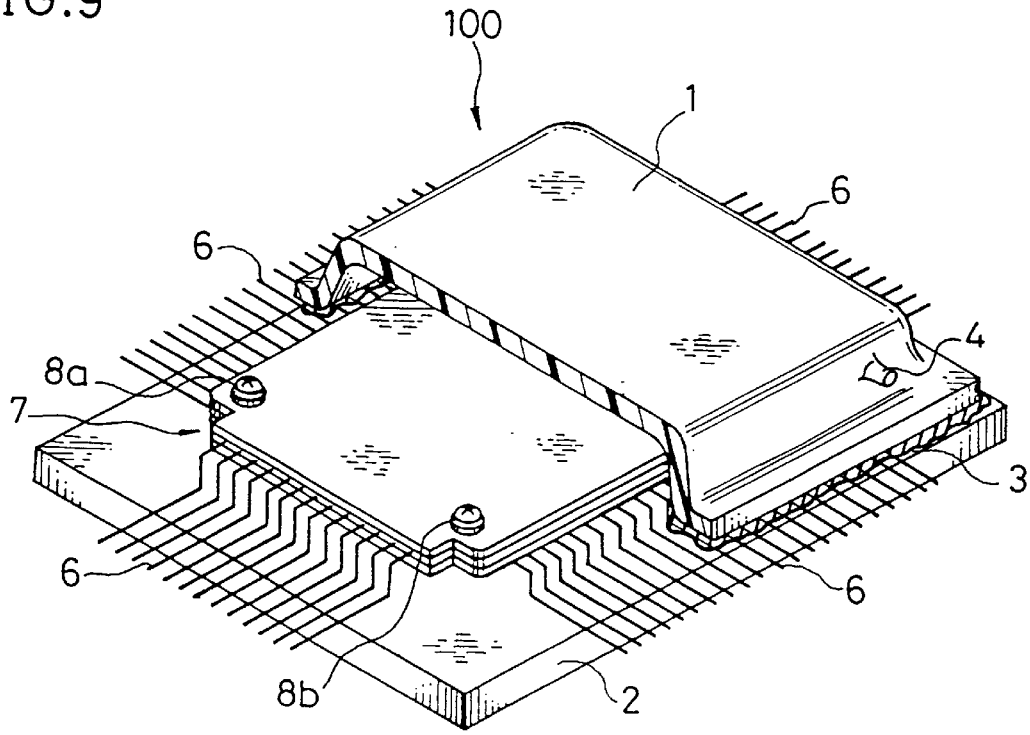
FIG. 9 is a cutaway perspective view, which is taken on line IX—IX of FIG. 8, showing a part of the flat type image display apparatus.
Figure 10:
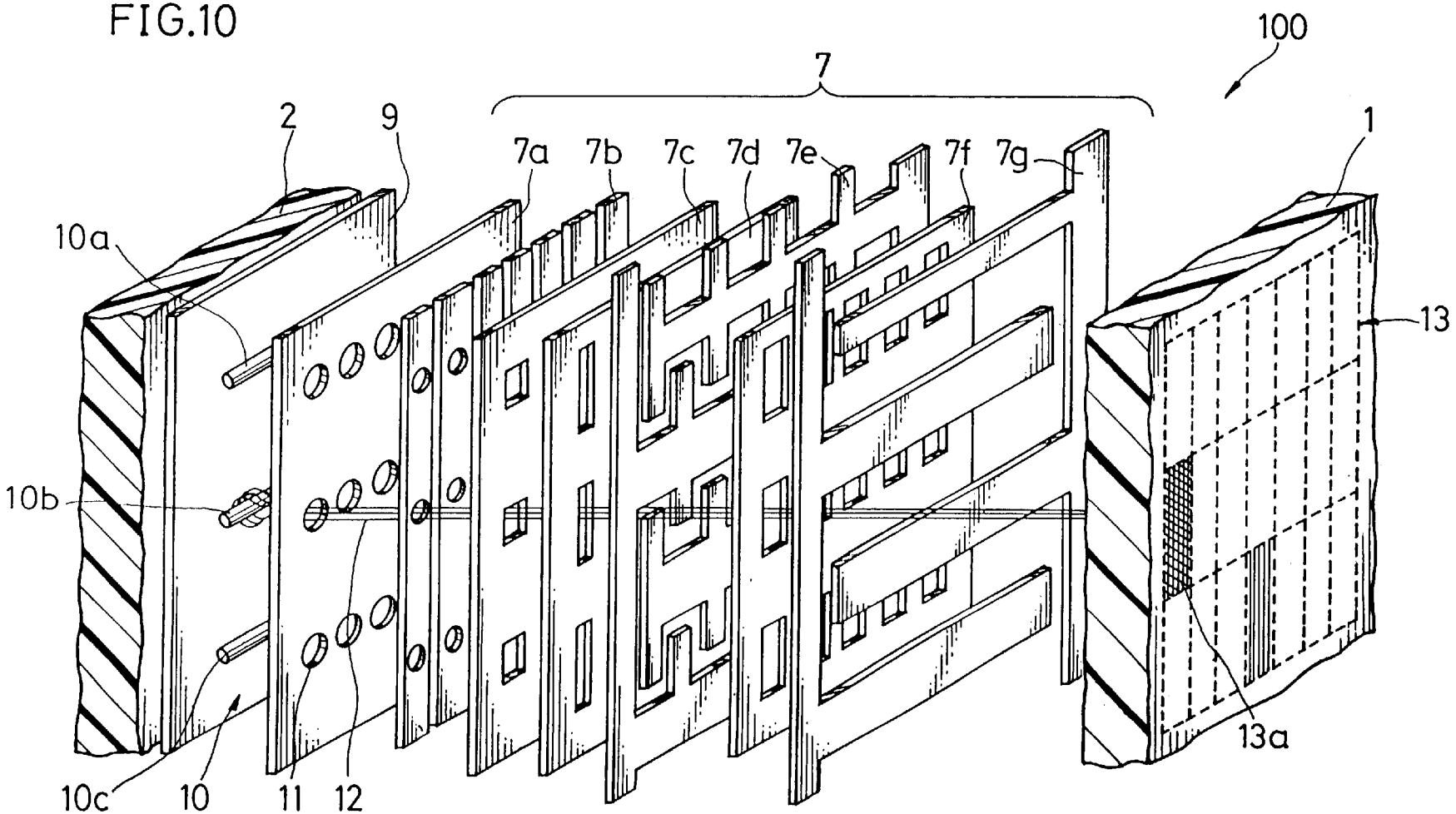
FIG. 10 is an exploded perspective view showing general construction of a main part of the flat type image display apparatus.
Figure 11:
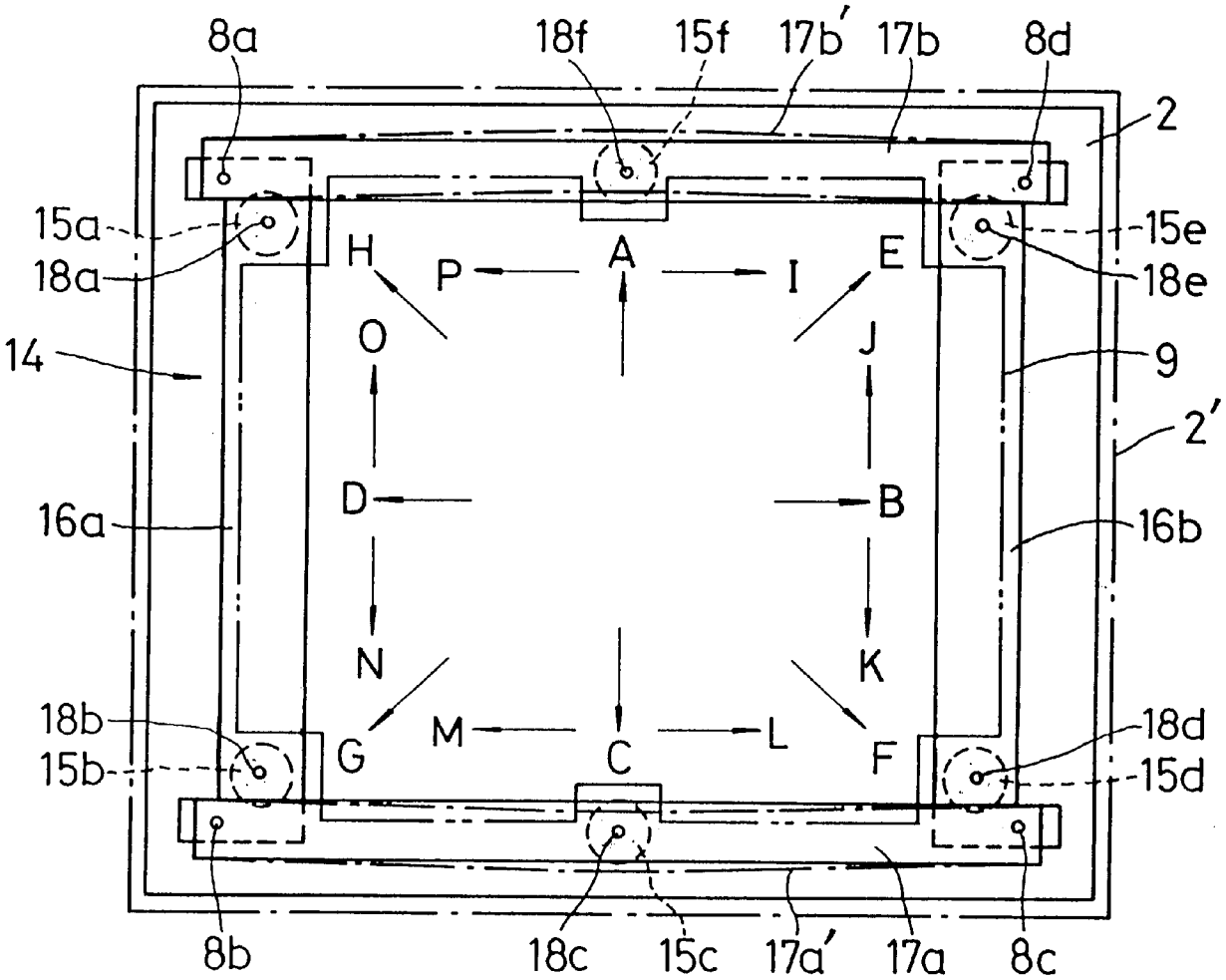
FIG.11 (Prior Art)
FIG. 11 is an explanatory view showing a conventional supporting unit for the flat-shaped electrode unit.
Figure 12:
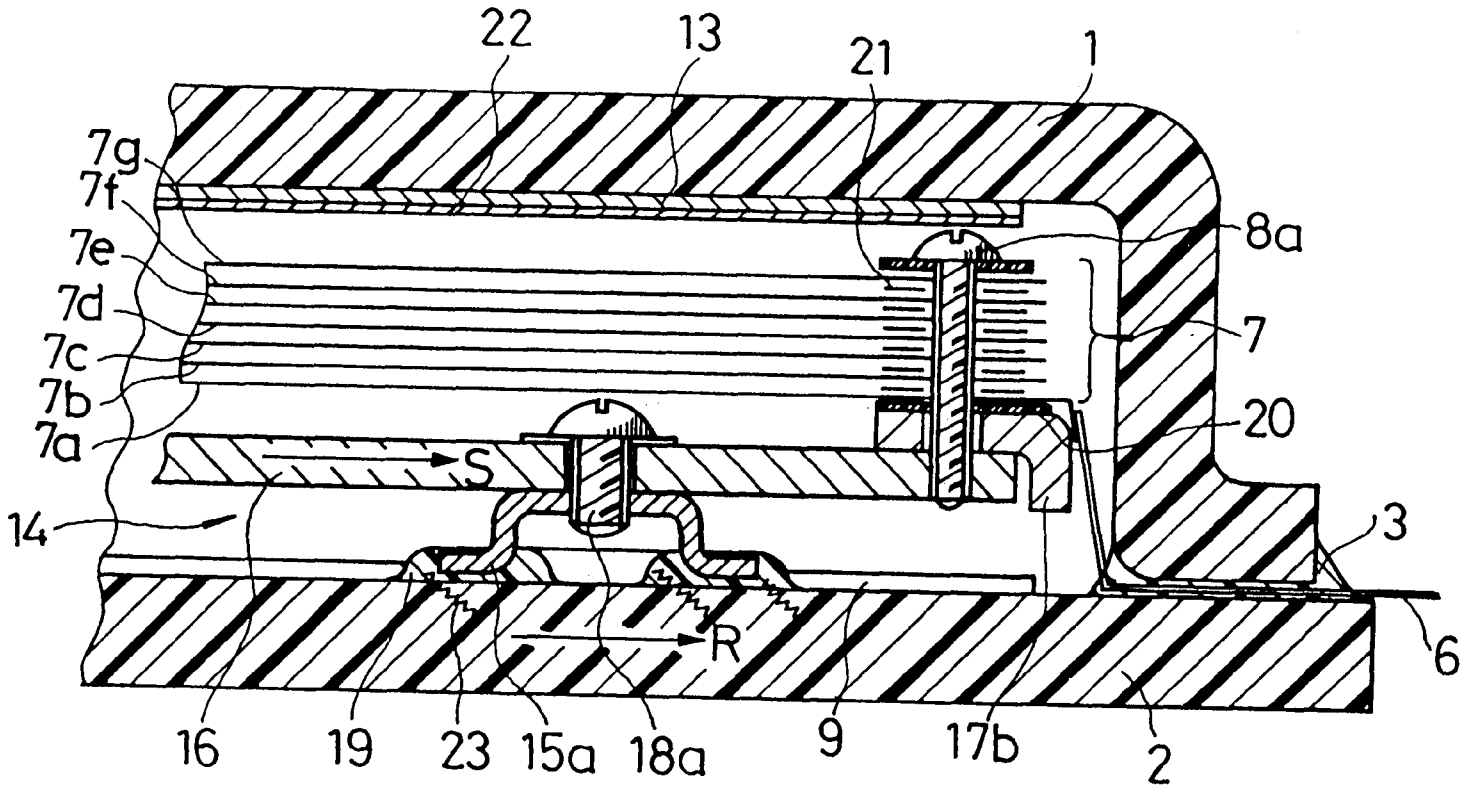
FIG.12 (Prior Art)
FIG. 12 is a partially sectional view, which is taken on line Z—Z of FIG. 8, showing the mounting construction of the conventional supporting unit at a corner part of the flat type image display apparatus.

Firstly, a concrete construction of the general flat type image display apparatus will be elucidated with reference to FIG. 8, FIG. 9 and FIG. 10. In the description of the present invention, a horizontal direction is shown by an arrow "X" of FIG. 8, and a vertical direction is shown by an arrow "Y" of FIG. 8. FIG. 8 is a perspective view showing the flat type image display apparatus. FIG. 9 is a cutaway perspective view, which is taken on line IX—IX of FIG. 8, showing a part of the flat type image display apparatus. FIG. 10 is an exploded perspective view showing general construction of a main part of the flat type image display apparatus.

As shown in FIG. 8, the flat type image display apparatus 100 has a vacuum case constituted by a front housing 1 and a rear panel 2. The front housing 1 and the rear panel 2 are made of glass which has a predetermined thickness, for example, 10 mm. Peripheral parts of the front housing 1 is fixed to the rear panel 2 by a bonding glass member 3, such as a soldering glass. The melting point of the bonding glass member 3 is selected lower than that of the front housing 1 or the rear panel 2, and the bonding glass member 3 seals the vacuum case via a melting and recrystallization. An evacuation pipe 4 for evacuating the vacuum case and a high voltage terminal 5 of an anode are provided on the edge of the front housing 1. Plural output terminals 6 are led out of the vacuum case through the bonding glass member 3.

As shown in FIG. 9, one ends of the plural output terminals 6 are connected with a flat-shaped electrode unit 7. In order to use the flat type image display apparatus 100 as a television receiver or a display unit of a computer, the other ends of the plural output terminals 6 are to be connected with external circuits (not shown), for example, a driving circuit and signal processing circuit.

The flat-shaped electrode unit 7 is constituted by plural flat-shaped electrodes 7*a*- - - 7*g* (FIG. 10). At four corners of the flat-shaped electrode unit 7, four securing screws 8*a*- - - 8*d* (FIG. 1) set the flat-shaped electrode unit 7 on a supporting unit 51 (FIG. 1) of the present invention, respectively. The flat-shaped electrodes 7*a*- - - 7*g* (FIG. 10) are made of an alloy, such as Ni and Fe (Ni:Fe=36%:64%).

As shown in FIG. 10, the main part of the flat type image display apparatus 100 comprises a back electrode 9, plural linear cathodes 10*a*- - - 10*c* and the flat-shaped electrode unit 7. The back electrode 9, plural linear cathodes 10*a*- - - 10*c* and the flat-shaped electrode unit 7 are provided from the rear panel 2 toward the front housing 1. The back electrode 9 is mounted on the inner surface of the rear panel 2. The linear cathodes 10*a*- - - 10*c* are horizontally stretched by a pair of heat-resistant insulating frames 50*a* and 50*b* (FIG. 1) so as to be in parallel with the back electrode 9. The linear cathodes 10*a*- - - 10*c* act as an electron beam source. Although only three pieces of the linear cathodes 10*a*- - - 10*c* are shown in FIG. 10 there are actually many linear cathodes (e.g. 44 pieces).

The flat-shaped electrode unit 7 comprises an electron beam extracting electrode 7*a*, a modulation electrode 7*b*, a vertical focussing electrode 7*c*, a horizontal focussing electrode 7*d*, a horizontal deflection electrode 7*e*, a shield electrode 7*f* and a vertical deflection electrode 7*g*. The respective electrodes 7*a*- - - 7*g* are bonded with each other keeping respective predetermined gaps held therebetween, and they are electrically insulated from each other by respective vitreous insulators (not shown).

As shown in FIG. 10, the electrons emitted from the linear cathode 10*b* is conducted by an extracting hole 11 of the electron beam extracting electrode 7*a* to form the electron beam 12. Thereafter, the electron beam 12 passes through holes and slits of the other electrodes 7*b*, 7*c*, 7*d*, 7*e*, 7*f* and 7*g*, thereby getting focussed and deflected. Finally, the electron beam 12 reaches a small segment 13*a* of a fluorescent screen 13 formed on the inner surface of the front housing 1. Many fluorescent dots of R, G and B colors are provided on the small segment 13*a* by known printing process, and the small segment 13*a* emits lights when the electron beam 12 lands on the fluorescent dots of the small segment 13*a*. Similarly, other electron beams land on the fluorescent dots of other small segments, and every small segment emits lights. As a result, a television moving picture is reproduced on the fluorescent screen 13. In FIG. 10, although the fluorescent screen 13 is divided into only 3 pieces in a vertical line and only 7 pieces in a horizontal line, the fluorescent screen 13 is actually divided into many small segments, such as 44 pieces in the vertical line and 221 pieces in the horizontal line, the total of 9724 pieces.

Figure 1:
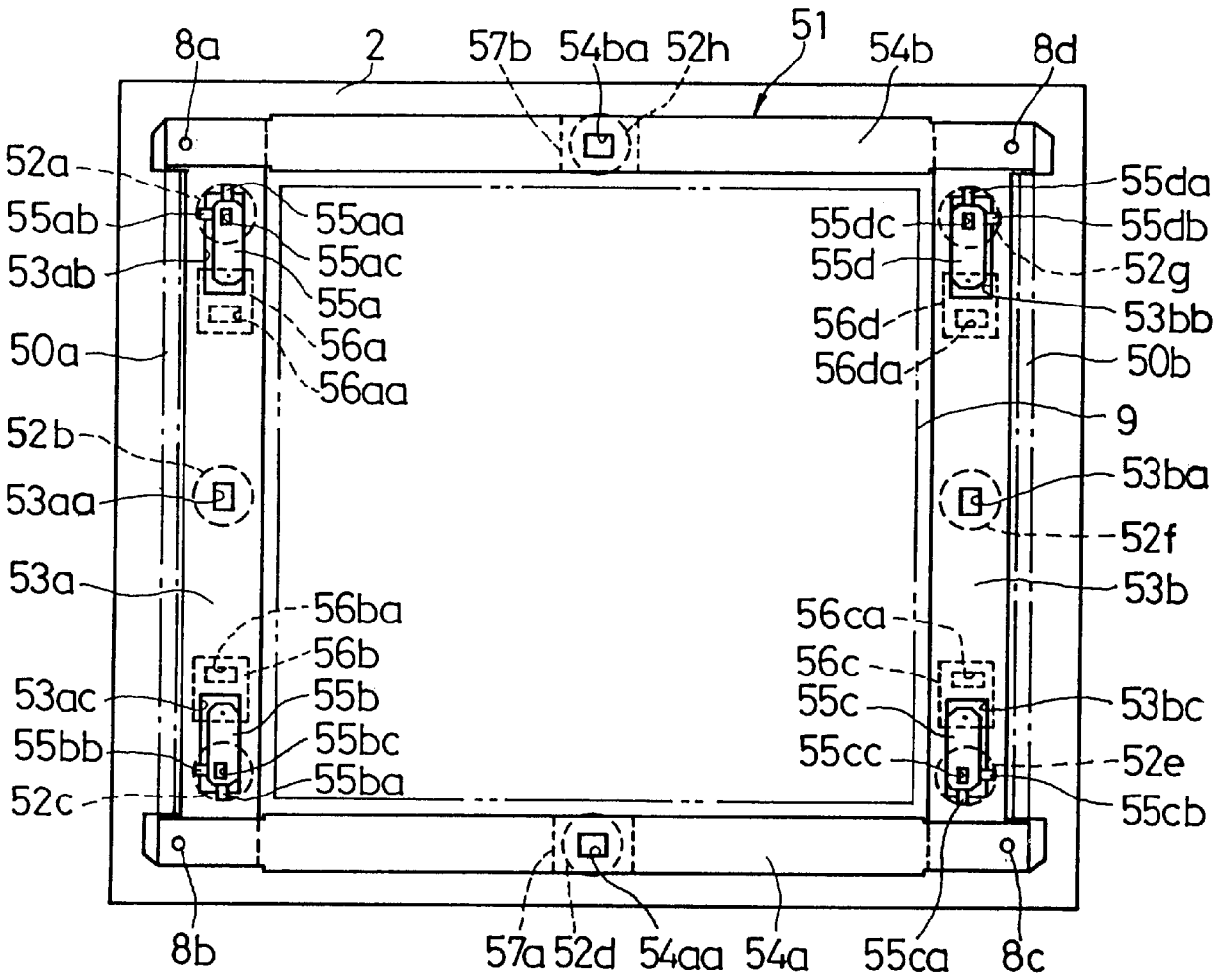
FIG. 1 is an explanatory view showing a supporting unit for a flat-shaped electrode unit in accordance with the present invention.
Figure 2:
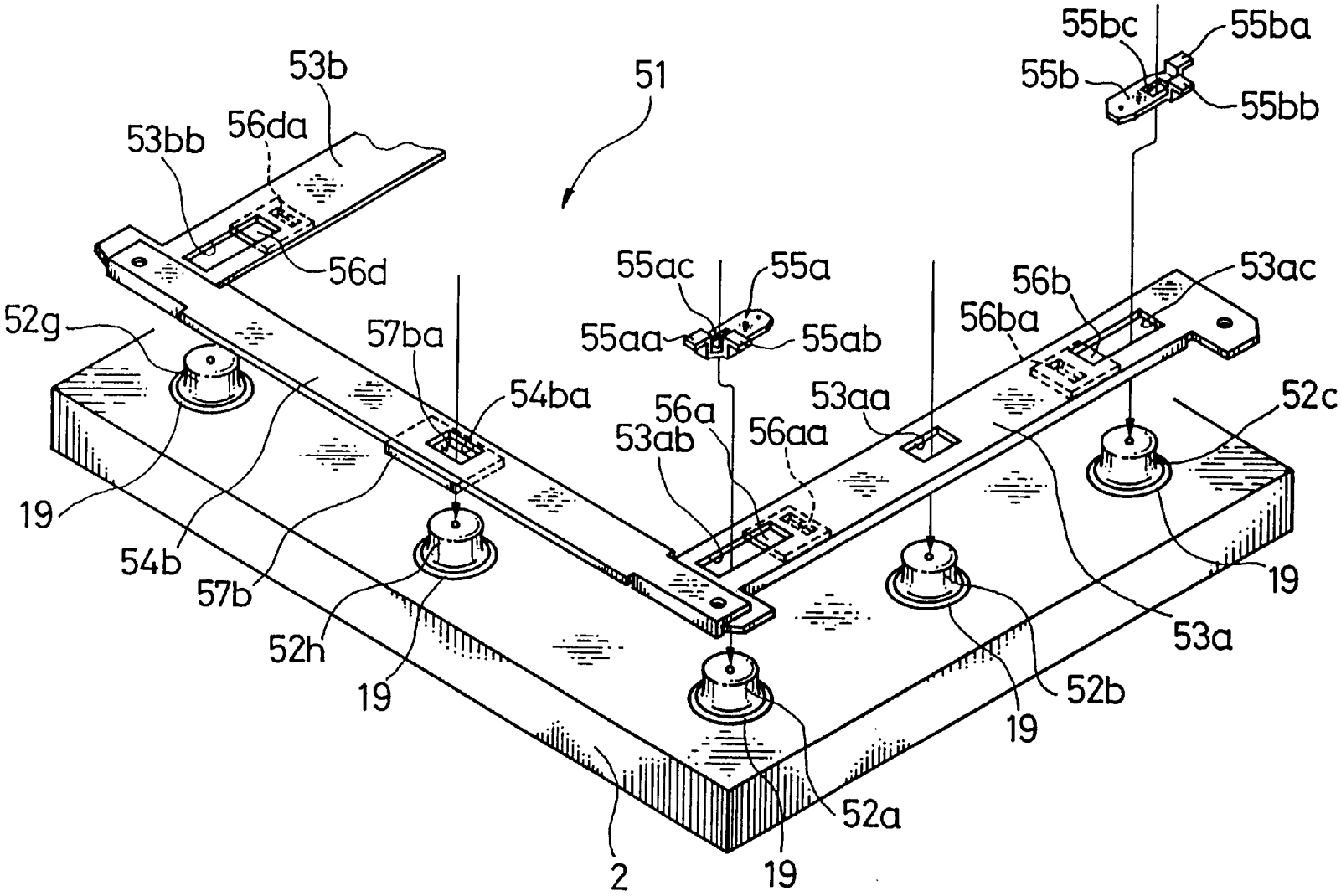
FIG. 2 is an exploded perspective view showing the construction of the supporting unit in accordance with the present invention.
Figure 3:
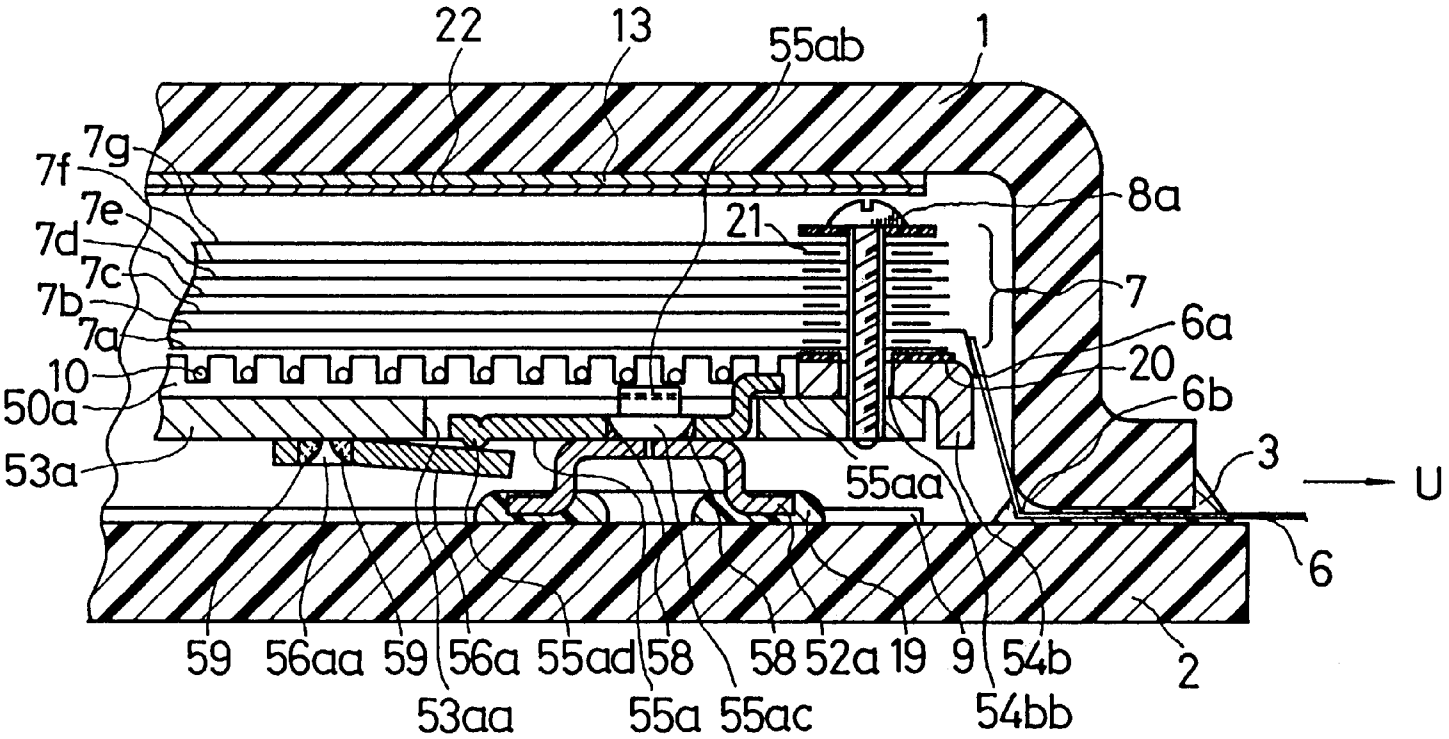
FIG. 3 is a partially sectional view, which is taken on line Z—Z of FIG. 8, showing the mounting construction of the supporting unit of the present invention at a corner part of the flat type image display apparatus.

A concrete construction of the supporting unit 51 for the flat-shaped electrode unit 7 in accordance with the present invention will be elucidated with reference to FIG. 1, FIG. 2 and FIG. 3. FIG. 1 is an explanatory view showing a supporting unit for a flat-shaped electrode unit in accordance with the present invention. FIG. 2 is an exploded perspective view showing the construction of the supporting unit in accordance with the present invention. FIG. 3 is a partially sectional view, which is taken on line Z—Z of FIG. 8, showing the mounting construction of the supporting unit of the present invention at a corner part of the flat type image display apparatus.

As shown in FIG. 1 and FIG. 2, the supporting unit 51 for the flat-shaped electrode unit 7 in accordance with the present invention comprises eight setting mounts 52*a*- - - 52*h*, a pair of securing members 53*a* and 53*b*, a pair of supporting members 54*a* and 54*b*, four tension plates 55*a*- - - 55*d*, four spring plates 56*a*- - - 56*d* and two spacers 57*a* and 57*b*.

The eight setting mounts 52*a*- - - 52*h* are made of the alloy, such as Ni and Fe (Ni:Fe=50%:50%), and fixed on a predetermined position of the rear panel 2 by a bonding glass member 19 so as to surround the back electrode 9 (shown in two-dot chain line). When the setting mounts 52*a*- - - 52*h* are fixed on the rear panel 2 by the bonding glass member 19, the bonding glass member 19 is heated and melted in a baking oven at the temperature of about 500° C. The melting point of the bonding glass member 19 is selected lower than that of the rear panel 2.

The securing members 53*a* and 53*b* are made of the alloy, such as Ni and Fe (Ni:Fe=36%:64%), and located in parallel with each other in the vertical direction. The securing member 53*a* is disposed on the setting mounts 52*a*, 52*b* and 52*c*. A first hole 53*aa* is formed at the intermediate part of the securing member 53*a* for welding the securing member 53*a* to the setting mount 52*b*. A second hole 53*ab* is formed at one end part of the securing member 53*a* for locating the tension plate 55*a*. A third hole 53*ac* is formed at the other end part of the securing member 53*a* for locating the tension plate 55*b*.

Figure 4A:
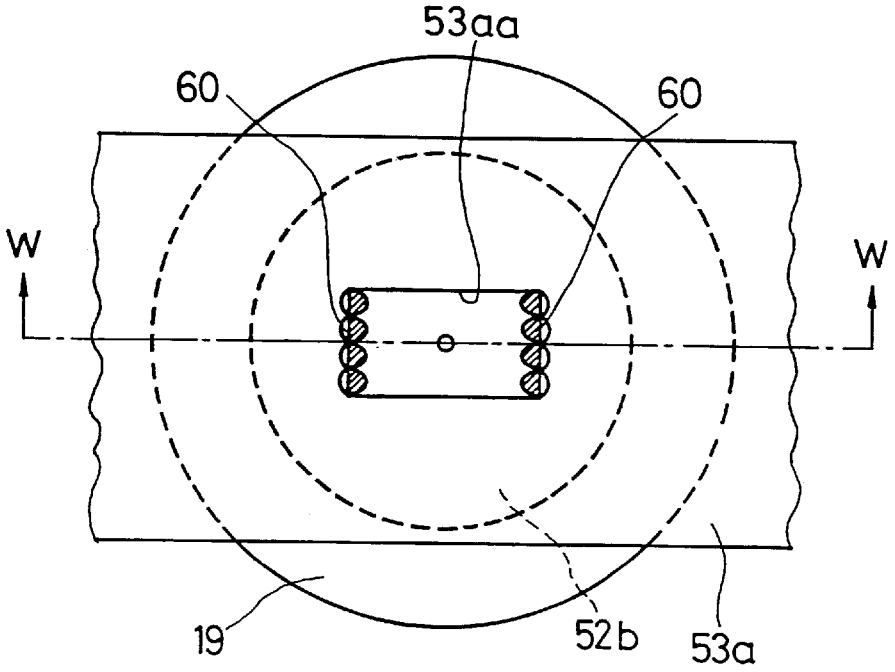
FIG. 4A is an enlarged view of welding parts between the securing member 53*a* and the setting mount 52*b*.
Figure 4B:
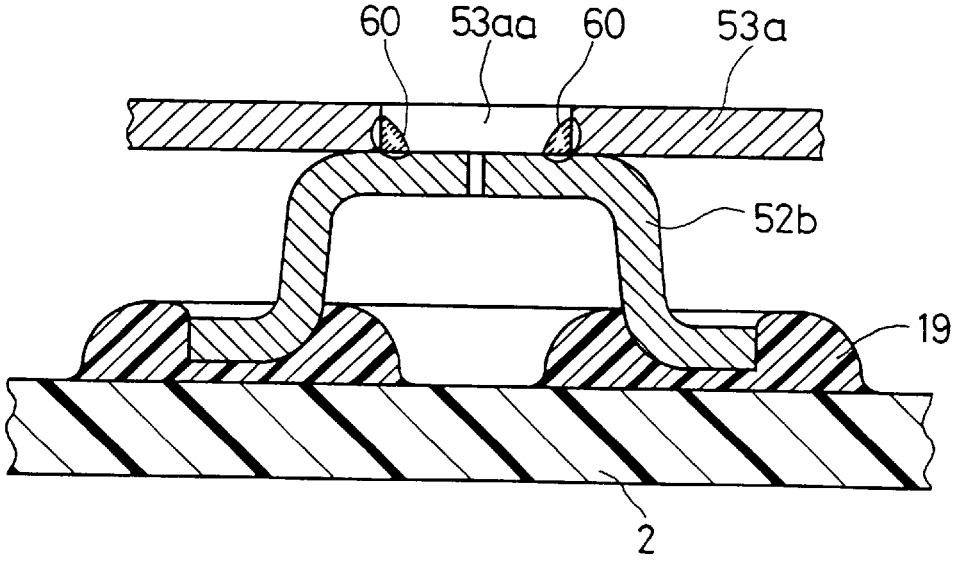
FIG. 4B is a sectional view, which is taken on line W—W of FIG. 4A, showing welding parts between the securing member 53*a* and the setting mount 52*b*.

A concrete welding method in the first hole 53*aa* will be elucidated with reference to FIG. 4A and FIG. 4B. FIG. 4A is an enlarged view of welding parts between the securing member 53*a* and the setting mount 52*b*. FIG. 4B is a sectional view, which is taken on line W—W of FIG. 4A, showing welding parts between the securing member 53*a* and the setting mount 52*b*.

As shown in the. FIG. 4A and FIG. 4B, the bottom parts of the inner walls of the first hole 53*aa* is fixed to the upper surface of the setting mount 52*b* by welding, such as a laser welding. Since this welding of the securing member 53*a* is performed in the bottom parts of the first hole 53*aa*, plural welding parts 60 do not protrude above a level of the upper surface of the securing member 53*a* as shown in FIG. 4A and FIG. 4B. Thereby, it is possible to prevent an undesirable electromagnetic influence on plural parts 60 of the flat type image display apparatus 100. Thus, the intermediate part of the securing member 53*a* is fixed to the setting mount 52*b* at the first hole 53*aa*.

Similarly, the securing member 53*b* is disposed on the setting mounts 52*e*, 52*f* and 52*g*. A first hole 53*ba* is formed at the intermediate part of the securing member 53*b* for welding the securing member 53*b* to the setting mount 52*f*. A second hole 53*bb* is formed at one end part of the securing member 53*b* for locating the tension plate 55*d*. A third hole 53*bc* is formed at the other end part of the securing member 53*b* for locating the tension plate 55*c*. The intermediate part of the securing member 53*b* is fixed to the setting mount 52*f* at the first hole 53*ba*.

Furthermore, as shown in FIG. 1, both ends of the heat-resistant insulating frame 50*a* shown by dashed lines are fitted to both ends of the securing member 53*a*, respectively. Thereby, the heat-resistant insulating frame 50*a* is disposed in parallel with the securing member 53*a* in the vertical direction. Similarly, both ends of the heat-resistant insulating frame 50*b* shown by dashed lines are fitted to both ends of the securing member 53*b*, respectively. Thereby, the heat-resistant insulating frame 50*b* is disposed in parallel with the securing member 53*b* in the vertical direction. As a result, the plural linear cathodes 10 (FIG. 3) are stretched horizontally between the two heat-resistant insulating frames 50*a* and 50*b* in parallel with each other.

The supporting members 54*a* and 54*b* are also made of the alloy, such as Ni and Fe (Ni:Fe=36%:64%), and located in parallel with each other in the horizontal direction. A first hole 54*aa* is formed at the intermediate part of the supporting member 54*a* for welding the supporting member 54*a* to the setting mount 52*d*. The intermediate part of the supporting member 54*a* is fixed to the setting mount 52*d* at the first hole 54*aa* via the spacer 57*a*. Similarly, a first hole 54*ba* is formed at the intermediate part of the supporting member 54*b* for welding the supporting member 54*b* to the setting mount 52*h*. The intermediate part of the supporting member 54*b* is fixed to the setting mount 52*h* at the first hole 54*ba* via the spacer 57*b*.

As shown in FIG. 1, both ends of the supporting member 54*a* are put on one end of the securing members 53*a* and 53*b*, and both ends of the supporting member 54*b* are put on the other end of the securing members 53*a* and 53*b*. Thereby, the securing members 53*a* and 53*b* and the supporting members 54*a* and 54*b* form a substantially rectangle shaped frame on the eight setting mounts 52*a*- - - 52*h*. The securing members 53*a* and 53*b* and the supporting members 54*a* and 54*b* form supporting means.

As shown in FIG. 3, an insulating film 20 is provided on the upper surface of the supporting member 54*a* and 54*b*, and the flat-shaped electrode unit 7 (FIG. 10) is disposed further thereon. At four corners of the supporting unit 51, the flat-shaped electrode unit 7, the securing members 53*a* and 53*b* and the supporting member 54*a* and 54*b* are fixed to each other by four securing screws 8*a*- - - 8*d*. The insulating film 20 is formed on the upper surface of the securing members 53*a* and 53*b*, for examples by thermal spraying of an alumina.

As shown in FIG. 1 and FIG. 3, a securing position of the securing screw 8*a* is located at the part outside with respect to the setting mount 52*a* in relation to the center part of the rear panel 29 and a securing position of the securing screw 8*b* is located at the part outside with respect to the setting mount 52*c* in relation to the center part of the rear panel 2. Similarly, a securing position of the securing screw 8*c* is located at the part outside with respect to the setting mount 52*e* in relation to the center part of the rear panel 29 and a securing position of the securing screw 8*d* is located at the part outside with respect to the setting mount 52*g* in relation to the center part of the rear panel 2. In the supporting members 54*a* and 54*b*, diameters of four holes for inserting respective four screws 8*a*- - - 8*d* are set larger than a diameter of four screws 8*a*- - - 8*d*. For example, as shown in FIG. 3, a diameter of a hole 54*bb* for inserting the screw 8*a* is set larger than a diameter of the screw 8*a*.

As shown in FIG. 3, insulating washers 21 are provided between every two flat-shaped electrodes around the securing screws 8*a*. A metal-backed layer 22 is provided on the inner surface of the fluorescent screen 13.

In FIG. 1, the four tension plates 55*a*- - - 55*d* and the four spring plates 56*a*- - - 56*d* are made of the alloy, such as a stainless steel. The four tension plates 55*a*- - - 55*d* and the four spring plates 56*a*- - - 56*d* form resilient retaining means, and are disposed at four corners of supporting means, respectively. The four tension plates 55*a*- - - 55*d* and the four spring plates 56*a*- - - 56*d* hold four end parts of the securing members 53*a* and 53*b*, respectively.

Figure 5:
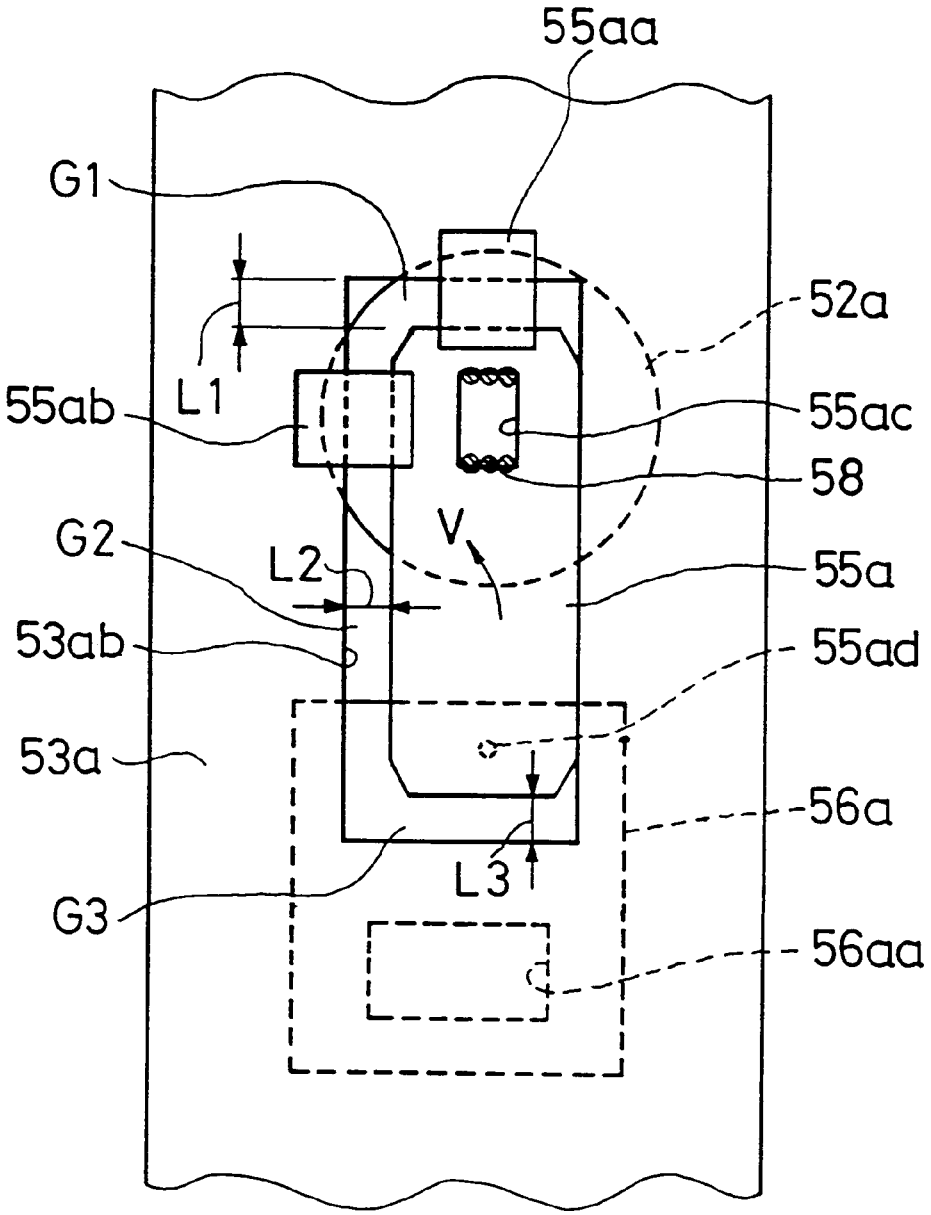
FIG. 5 is an enlarged view showing resilient retaining means of the present invention.

A concrete example of this resilient retaining means of the present invention will be elucidated with reference to FIG. 3 and FIG. 5. FIG. 5 is an enlarged view showing resilient retaining means of the present invention.

As shown in FIG. 3 and FIG. 5, the tension plate 55*a* comprises a first hook 55*aa*, a second hook 55*ab*, a hole 55*ac* and a protruding portion 55*ad*. The spring plate 56*a* has a hole 56*aa*. Each of the first hook 55*aa* and the second hook 5 serves as a stopper to limit deformations of the securing member 53*a*. That is, when the tension plate 55*a* is fixed to the setting mount 52*a*, each of the first hook 55*aa* and the second hook 55*ab* is disposed above the upper surface of the securing member 53*a* as shown in FIG. 3. If one end part of the securing member 53*a* is warped more than a predetermined degree by thermal deformation, the first hook 55*aa* and the second hook 55*ab* come in contact with one end part of the securing member 53*a*, respectively. As a results deformations of the securing member 53*a* is limited under the predetermined degree. It is possible that the first hook 55*aa* and the second hook 55*ab* also limit deformations of the securing member 53*a* caused by external vibration and shock.

Apart from the aforementioned explanation, where the tension plate 55*a* has two hooks 55*aa* and 55*ab* as the stopper, an alternative construction may be such that the tension plate 55*a* has one hook, for example, the first hook 55*aa* only.

As shown in FIG. 3 and FIG. 5, the hole 55*ac* is formed in the tension plate 55*a* for welding the tension plate 55*a* to the setting mount 52*a*. Since this welding of the tension plate 55*a* is performed in the bottom parts of the hole 55*ac* as well as the welding of the securing member 53*a*, plural welding parts 58 do not protrude above a level of the surface of the tension plate 55*a* as shown in FIG. 3.

As shown in FIG. 3, the protruding portion 55*ad* is provided on one surface of the tension plate 55*a* so as to project toward the rear panel 2. This protruding portion 55*ad* is formed by pushing the other surface of the tension plate 55*a*.

As shown in FIG. 3 and FIG. 5, the spring plate 56*a* is fixed to a rear side of the securing member 53*a* so as to cover a predetermined part of the second hole 53*ab*. Since this welding of the spring plate 56*a* is performed in the bottom parts of the hole 55*ac* as well as the welding of the securing member 53*a*, plural welding parts 59 do not protrude above a level of the surface of the spring plate 56*a* as shown in FIG. 3.

When the tension plate 55*a* is fixed to the setting mount 52*a*, the protruding portion 55*ad* abuts on the spring plate 56*a*. Thereby, the spring plate 56*a* is pressed down toward the rear panel 2. Thus, the end part of the securing member 53*a* is elastically held by the tension plate 55*a* and the spring plate 56*a*. It is preferred that elasticity of the tension plate 55*a* is larger than that of the spring plate 56*a*.

Apart from the aforementioned explanation, where the spring plate 56*a* having elasticity is fixed to the securing member 53*a* by weldings an alternative way of construction may be such that the spring plate 56*a* and the securing member 53*a* are formed integrally, and the securing member 53*a* is held by elasticity of the tension plate 55*a*.

As shown in FIG. 5, when the tension plate 55*a* is fixed to the setting mount 52*a* in the second hole 53*ab*, three gaps G1, G2 and G3 are formed at the part outside with respect to the tension plate 55*a* in relation to the center part of the rear panel 2 in the second hole 53*ab*.

In this embodiment, when the flat type image display apparatus 100 is heated degrees of the thermal deformations are larger as the order advances from the rear panel 2 through the frame of the supporting unit 51 and to the flat-shaped electrode unit 7. Therefore, when the flat type image display apparatus 100 is heated, the tension plate 55*a* is moved toward the part outside in relation to the center part of the rear panel 2 by the deformation of the rear panel 2, such as shown by an arrow "V" shown in FIG. 5. As a result, the tension plate 55*a* absorbs a difference in degrees of thermal deformations between the rear panel 2, the flat-shaped electrode unit 7 and the frame of the supporting unit 51 eliminating from giving an undesirable stress to the flat-shaped electrode unit 7.

Sizes of L1, L2 and L3 of the gaps G1, G2 and G3 as shown in FIG. 3 are as follows:

L1=2 mm, L2=1 mm, L3=2 mm.

Furthermore, as has been elucidated in the above, the protruding portion 55*ad* of the tension plate 55*a* only abuts on the spring plate 56*a*. Therefore, when the tension plate 55*a* is moved with the tilt to the spring plate 56*a*, it is possible that the tension plate 55*a* smoothly tilts to the spring plate 56*a*.

In the aforementioned explanation, the tension plate 55*a* and the spring plate 56*a*, which are located at the upper-left side of FIG. 1, are described. Each of the tension plates 55*b*, 55*c* and 55*d* is configured as same as the tension plate 55*a*, and each of the spring plates 56*b*, 56*c* and 56*d* is configured as same as the spring plate 56*a*. That is, in FIG. 1, each of hooks 55*ba*, 55*ca* and 55*da* corresponds to the first hook 55*aa*, and each of hooks 55*bb*, 55*cb* and 55*db* corresponds to the second hook 55*ab*. Furthermore, each of holes 55*bc*, 55*cc* and 55*dc* corresponds to the hole 55*ac*, and each of holes 56*ba*, 56*ca* and 56*da* corresponds to the hole 56*aa*. A protruding portion (not shown) is provided on the tension plates 55*b*, 55*c* and 55*d* for abutting on the respective the spring plates 56*b*, 56*c* and 56*d*. Therefore, explanations of the tension plates 55*b*, 55*c* and 55*d* and the spring plates 56*b*, 56*c* and 56*d* are omitted.

As shown in FIG. 1, the spacer 57*a* is provided between the supporting member 54*a* and the setting mount 52*d*. The spacer 57*a* is fixed to the supporting member 54*a* and the setting mount 52*d* at a hole 57*aa* (FIG. 6) by welding. This welding method of the spacer 57*a* is as same as the welding method of the securing member 53*a*. Similarly, the spacer 57*b* is provided between the supporting member 54*b* and the setting mount 52*h*. The spacer 57*b* is fixed to the supporting member 54*b* and the setting mount 52*h* at a hole 57*ba* (FIG. 2) by welding. This welding method of the spacer 57*b* is as same as the welding method of the securing member 53*a*.

Figure 6:
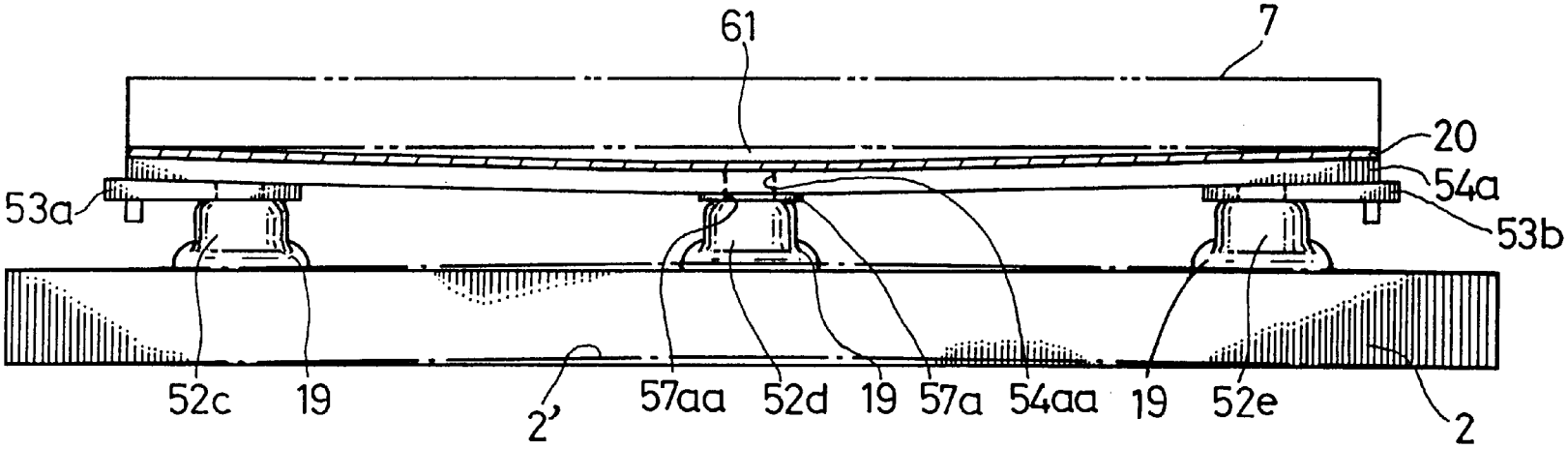
FIG. 6 is a lateral view showing the supporting unit in accordance with the present invention.

A function of the spacer 57*a* will be elucidated with reference to FIG. 6. FIG. 6 is a lateral view showing the supporting unit in accordance with the present invention. Since the spacer 57*b* is configured as same as the spacer 57*a*, the explanation of the spacer 57*b* applies as it is to the former, and hence its explanation is omitted.

As shown in FIG. 6, thickness of the spacer 57*a* is smaller than those of the securing members 53*a* and 53*b*. Furthermore, three setting mounts 52*c*, 52*d* and 52*e* are fixed to the rear panel 2 with a predetermined height from the rear panel 2. Accordingly, in height of the supporting member 54*a* from the rear panel 2, a height of the intermediate part is lower than heights of both end parts. That is, the intermediate part of the supporting member 54*a* is fixed to the setting mount 52*d* via the spacer 57*a* so that a clearance 61 is formed between the intermediate part of the supporting member 54*a* and the flat-shaped electrode unit 7. For example, the clearance 61 is about 40 microns between the insulating film 20 and the flat-shaped electrode unit 7.

When the vacuum case is evacuated by the evacuation pipe 4, the rear panel 2 is deformed into the rear panel 2' shown by dashed lines of FIG. 6. Thereby, the intermediate part of the supporting member 54*a* is pushed toward the flat-shaped electrode unit 7 via the setting mount 52*d* and the spacer 57*a*. However, since the clearance 61 is provided between the intermediate part of the supporting member 54*a* and the flat-shaped electrode unit 7, the intermediate part of the supporting member 54*a* does not come in contact with the flat-shaped electrode unit 7. Thus, the clearance 61 absorbs the deformation of the supporting member 54*a* eliminating from giving an undesirable stress to the flat-shaped electrode unit 7.

Apart from the aforementioned explanation, wherein thickness of the spacer 57*a* is smaller than those of the securing members 53*a* and 53*b*, and heights of the setting mounts 52*c*, 52*d* and 52*e* from the rear panel 2 are as same as each other, an alternative construction may be such that height of the setting mount 52*d* from the rear panel 2 is lower than those of the setting mounts 52*c* and 52*e* without the spacer 57*a*.

With respect to the securing members 53*a* and 53*b*, the countermeasure against the evacuation of the vacuum case is not required. That is because, for example, as shown in FIG. 3, the securing member 53*a* is disposed under the supporting member 54*b* against the flat-shaped electrode unit 7. Thereby, when the vacuum case is evacuated by the evacuation pipe 4, the intermediate part of the securing member 53*a* does not come in contact with the flat-shaped electrode unit 7 after the intermediate part of the securing member 53*a* is pushed toward the flat-shaped electrode unit 7 via the setting mount 52*b* (FIG. 1). As has been elucidated in the above, the heat-resistant insulating frame 50*a* are only fitted to the securing member 53*a* at both ends of the heat-resistant insulating frame 50*a*. Therefore, when the vacuum case is evacuated by the evacuation pipe 4, the intermediate part of the heat-resistant insulating frame 50*a* does not push the flat-shaped electrode unit 7. As a result, the plural linear cathodes 10 does not receive an undesirable stress from the heat-resistant insulating frame 50*a*.

Thus, in the supporting unit 51 of the present invention, when the vacuum case is evacuated by the evacuation pipe 4, the flat-shaped electrode unit 7 and the plural linear cathodes 10 do not receive an undesirable stress. These functions against the flat-shaped electrode unit 7 and the plural linear cathodes 10 are effectively performed not only in deformations caused by the evacuation but also deformations caused by heat, the external vibrations and shocks.

Furthermore, the supporting unit 51 of the present invention has technical advantages as follows:

(1) Since the frame of the supporting unit 51 is of the same material as the flat-shaped electrode unit 7, a difference in degrees of thermal deformations between the frame of the supporting unit 51 and the flat-shaped electrode unit 7 is smaller than that of the prior art. As a result, the stress of the flat-shaped electrode unit 7 given from the distortion of the frame is substantially eliminated.

(2) As has been elucidated in the above, the four intermediate parts of the frame are fixed to the rear panel 2 via the respective setting mounts 52*b*, 52*d*, 52*f* and 52*h*, and the four corners of the frame are held by the resilient retaining means consisted of the tension plates 55*a*- - - 55*d* and the spring plates 56*a*- - - 56*d*. Therefore, the four corners of the frame make the largest displacement from the corresponding parts on the rear panel 2, the flat-shaped electrode unit 7 and the frame. As a result, it is possible that the resilient retaining means eliminates the largest difference given to the flat-shaped electrode unit 7 through moving of the tension plates 55*a*- - - 55*d* in the respective holes 53*ab*, 53*ac*, 53*bb* and 53*bc*. Accordingly, it is possible to prevent generations of the cracks in the rear panel 2 and the bonding glass member 19 for fixing the setting mounts 52*a*- - - 52*h*.

(3) The tension plates 55*a*, 55*b*, 55*c* and 55*d* are disposed in the holes 53*ab*, 53*ac*, 53*bb* and 53*bc*, respectively so as to form three gaps G1, G2 and G3 in the respective holes 53*ab*, 53*ac*, 53*bb* and 53*bc*. Furthermore, the clearance 61 is provided between the flat-shaped electrode unit 7 and the supporting members 54*a* and 54*b*. Thereby, these gaps G1, G2 and G3 and the clearance 61 can relieve defects caused by the size differences of the securing members 53*a* and 53*b*, as well as, that of the supporting members 54*a* and 54*b* and assembly of the supporting unit 51. Therefore, it is possible to assemble the supporting unit 51 easily.

Moreover, in this preferred embodiment, when peripheral parts of the front housing 1 is fixed to the rear panel 2 by the bonding glass member 3, the output terminals 6 are pulled toward the part outside of the vacuum case with a predetermined force. Concretely, for example, in FIG. 3, when peripheral parts of the front housing 1 is fixed to the rear panel 2 by the bonding glass member 3, a curve part 6*b* of the output terminal 6 is likely to be pulled toward a connecting part 6*a* of the output terminal 6 by the thermal deformation of the flat-shaped electrode 7*b*. In this preferred embodiment, when peripheral parts of the front housing 1 is fixed to the rear panel 2 by the bonding glass member 3, the output terminal 6 is pulled with a predetermined force in a direction of an arrow "U" of FIG. 3. As a result, it is possible to prevent the thermal deformation of the flat-shaped electrode 7*b*.

A MODIFIED VERSION OF THE PREFERRED EMBODIMENT

Figure 7:
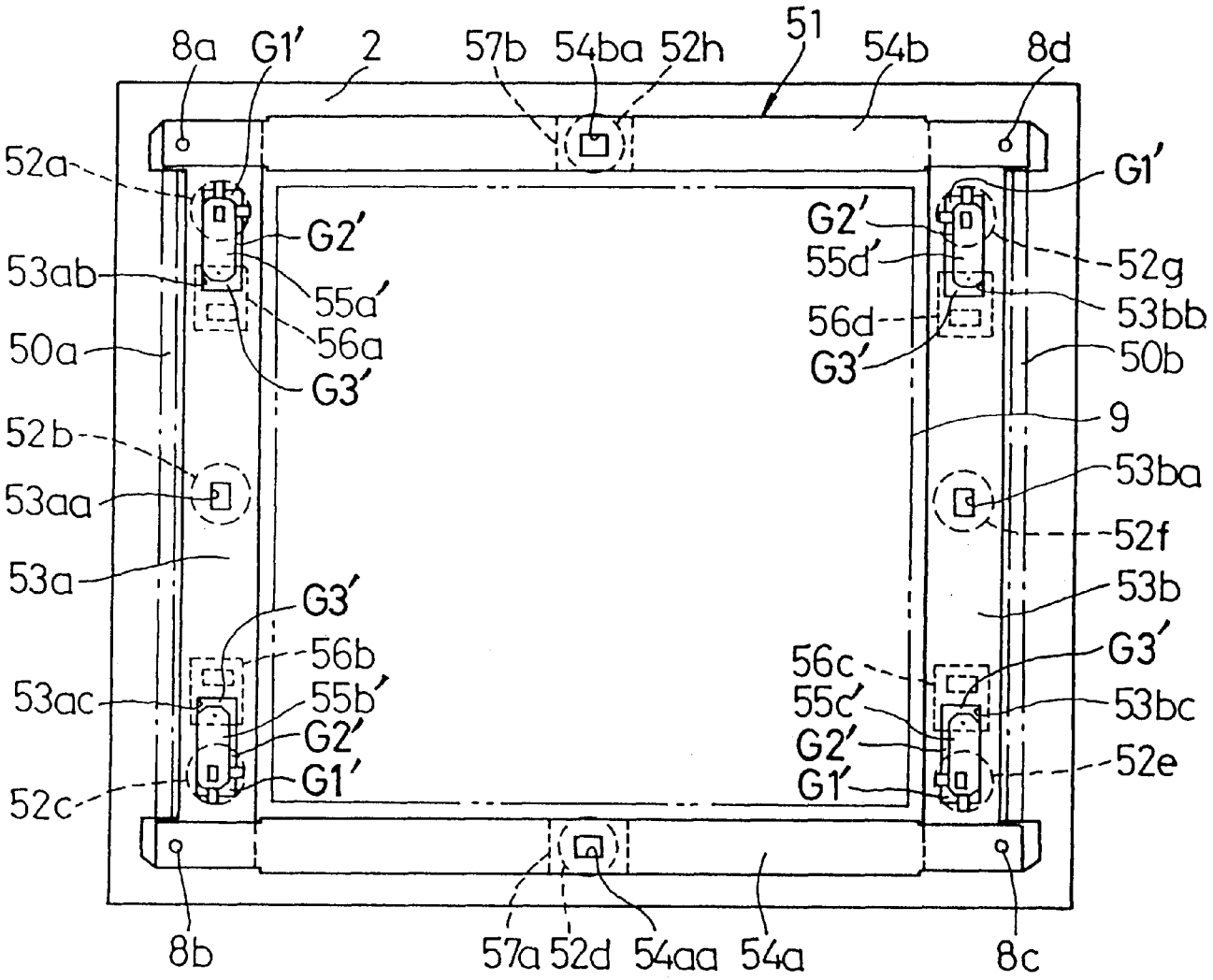
FIG. 7 is a front view of a modified version of the supporting unit in accordance with the preferred embodiment of the present invention.

A modified version of the preferred embodiment will be elucidated with reference to FIG. 7, which is a front view of a modified version of the supporting unit in accordance with the preferred embodiment of the present invention. In this modified version, the same components and parts as those of the preferred embodiment are designated by the same numerals, and corresponding descriptions similarly apply. Therefore, the descriptions will be made mainly on the modified parts from the preferred embodiment.

In this modified version, the frame of the supporting unit 51 and the flat-shaped electrode unit 7 are made of a metal, such as Fe. Thereby, when the flat type image display apparatus 100 is heated, degrees of the thermal deformations are larger as the order advances from the frame of the supporting unit 51 through the flat-shaped electrode unit 7 and to the rear panel 2.

Accordingly, as shown in an upper-left side corner of FIG. 7, for example, when the tension plate 55*a*' is fixed to the setting mount 52*a* in the second hole 53*ab*, the three gaps G1', G2' and G3' are formed at the part inside with respect to the tension plate 55*a*' in relation to the center part of the rear panel 2 in the second hole 53*ab*.

When the flat type image display apparatus 100 is heated, the tension plate 55*a*' is moved toward the part inside in relation to the center part of the rear panel 2. As a result, the tension plate 55*a*' absorbs a difference in degrees of thermal deformations between the rear panel 2, the flat-shaped electrode unit 7 and the frame of the supporting unit 51 without giving an undesirable stress to the flat-shaped electrode unit 7.

Although the present invention has been described in terms of the presently preferred embodiment, it is to be understood that such disclosure is not to be interpreted as limiting. Various alternations and modifications will no doubt become apparent to those skilled in the art after having read the above disclosure. Accordingly, it is intended that the appended claims be interpreted as covering all alternations and modifications as fall within the true spirit and scope of the invention.

What is claimed is:

1. A method for fabricating a supporting unit in a flat type image display apparatus, said method comprising the steps of:

fixing a plurality of setting mounts on a rear panel by bonding each of said setting mounts to said rear panel with a bonding glass member;

disposing a pair of securing members over said rear panel and on said plurality of setting mounts, each of said pair of securing members having a first hole formed at an intermediate part of said securing members and second and third holes formed at each end of said securing members;

welding a bottom part of an inner wall of said first hole of each securing member to an upper surface of one of said plurality of setting mounts;

disposing ends of a pair of supporting members on ends of said securing members in such a manner to form a substantially rectangularly shaped frame on said plurality of setting mounts, each of said supporting members having a hole formed at an intermediate part of said supporting members;

welding a bottom part of an inner wall of said hole of each supporting member to an upper surface of one of said plurality of setting mounts;

disposing a tension plate in each of said second and third holes of said securing members in such a manner to form three gaps in each of said second and third holes, each of said tension plates having a hole formed therein; and welding a bottom part of an inner wall of said hole of each of said tension plates to an upper surface of one of said plurality of setting mounts.

2. A method for fabricating a supporting unit in accordance with claim 1, wherein said step of welding the securing members is executed by laser welding the bottom part of the inner wall of the first hole of each securing member to the plurality of setting mounts.

* * * * *